United States Patent [19]

Omori et al.

[11] 4,262,843

[45] Apr. 21, 1981

[54] METHOD OF AND APPARATUS FOR CONTROLLING THE FEED AMOUNT OF AIR FOR COMBUSTION IN A NATURAL DRAFT-TYPE HEATING FURNACE

[75] Inventors: Keizo Omori, Kawasaki; Yasuhiro Suzuki, Yokohama, both of Japan

[73] Assignee: Nippon Petroleum Refining Co., Ltd., Tokyo, Japan

[21] Appl. No.: 9,825

[22] Filed: Feb. 6, 1979

[30] Foreign Application Priority Data

Feb. 10, 1978 [JP] Japan ..... 53-14517
Feb. 10, 1978 [JP] Japan ..... 53-14518

[51] Int. Cl.[3] ..... F23N 3/00; F23N 1/00

[52] U.S. Cl. ..... 236/15 C; 236/15 E; 236/20 R; 431/20

[58] Field of Search ..... 236/15 BD, 15 E, 20 R, 236/15 C; 431/19, 20, 76

[56] References Cited

U.S. PATENT DOCUMENTS 4,043,743 8/1977 Seider ..... 236/15 E
4,150,939 4/1979 Hayes ..... 236/15 E

*Primary Examiner*—William E. Wayner
*Attorney, Agent, or Firm*—Birch, Stewart, Kolasch & Birch

[57] ABSTRACT

A method of and apparatus for controlling the feed amount of air for combustion in a natural draft type heating furnace is disclosed, in which the draft pressure, the oxygen concentration in a combustion gas, the opening degree of a damper for controlling the flow rate of the combustion exhaust gas, the flow rate of a fluid to be heated and the temperatures of the fluid to be heated at inlet and outlet portions of the heating furnace are measured, and the feed amount of air for combustion is controlled based on measured values obtained at predetermined time intervals or corrected values thereof.

15 Claims, 10 Drawing Figures

| Fig. 2A(a) | Fig. 2A(b) | Fig. 2A(c) |
|---|---|---|

1
2
3
SIGNAL FOR LOWERING O2 CONCENTRATION ? (24)
YES
NO
ABNORMAL OPENING DEGREE OF DAMPER ? (25)
YES
NO
MESSAGE
(37)
ABNORMAL DRAFT PRESSURE (P) ?
YES
NO
MESSAGE
CALCULATION OF AVERAGE VALUE Pm FROM THREE P VALUES
MAINTAINING DAMPER OPENING DEGREE AS IT IS (38),(39)
ENDING

METHOD OF AND APPARATUS FOR CONTROLLING THE FEED AMOUNT OF AIR FOR COMBUSTION IN A NATURAL DRAFT-TYPE HEATING FURNACE

BACKGROUND OF THE INVENTION (1) Field of the Invention

The present invention relates to a method of and apparatus for controlling a combustion state in a natural draft type heating furnace for heating a fluid to be heated, which flows through the furnace, in a heat exchanger by heat exchange from a combustion gas, wherein the feed amount of air for combustion is controlled to maintain a good and safe combustion state.

(2) Description of the Prior Art

In a natural draft type heating furnace which is broadly used in a petrochemical plant or the like, the feed amount of air for combustion, which is naturally introduced into the furnace from an air intake opening of a burner, is minutely adjusted by controlling the opening degree of a damper attached to an exhaust gas discharge duct (opening) of the heating furnace.

In this natural draft furnace, when the amount of air fed into the furnace is unnecessarily large, the interior of the furnace is cooled by air not used for combustion and as fuel consumption is increased, an economical disadvantage is brought about. Accordingly, it is preferred that air for combustion be fed in an amount required for heating a fluid to be heated. For this purpose, there has been adopted a method in which the pressure of the combustion gas in the furnace (the draft pressure) is measured and the opening degree of the damper is controlled to maintain the draft pressure at a slightly negative level approximating that of atmospheric pressure so that air can be fed in a minimum required amount. In the draft furnace, however, the draft pressure is locally increased or decreased. Therefore, the draft pressure at the measuring part does not always correspond to the amount of air i.e., the amount of oxygen in the furnace. Accordingly, even if the measured value of the draft pressure indicates an appropriate feed amount of air, it often happens that incomplete combustion takes place because of a shortage of the amount of oxygen throughout the furnace. In this case, if the feed amount of air is instantaneously increased, explosive combustion is caused and there is a risk of damage to or destruction of the furnace. Accordingly, if the amount of oxygen is thus insufficient, the opening degree of the damper should be temporarily increased.

For control of the opening degree of the damper in the conventional draft furnace, there have been adopted a method in which the opening degree of the damper is manually controlled appropriately according to the indicated pressure while watching values on a draft pressure gauge (in many cases, a pressure indicating meter is disposed in a control room and remote control is performed in this room) and a method in which the opening degree of the damper is automatically controlled to a predetermined level in response to the draft pressure detected by a draft pressure sensor.

The former manual control method is defective in that control precision is low and economical utilization of the fuel cannot be sufficiently attained. Further, an operator must always watch the draft pressure gauge and the control operation becomes tiring and difficult. In the latter control method, since the opening degree is controlled only on the draft pressure, control precision is similarly insufficient and since it is very difficult to cope with a temporary shortage of the amount of oxygen in the furnace, the method involves a problem as regards the safety of the operation. Therefore, this method is hardly adopted actually in the art.

SUMMARY OF THE INVENTION

It is therefore a primary object of the present invention to overcome and eliminate the foregoing defects and disadvantages of the conventional techniques by means of an improved control system for a natural draft type heating furnace.

Another object of the present invention is to provide a method of and apparatus for controlling the amount of air for combustion in a natural draft type heating furnace, in which not only the draft pressure but also the the oxygen concentration in a combustion exhaust gas are measured at predetermined time intervals and the opening degree of the damper is precisely and stably controlled based on the measured values for controlling the feed amount of air to a necessary and sufficient level, whereby both the requirements of economical utilization of the fuel and safety of the operation of the heating furnace can be simultaneously satisfied.

A further object of the present invention is to provide a method of and apparatus for controlling the amount of air for combustion in a natural draft type heating furnace, in which the flow rate of a fluid to be heated and the temperatures of the fluid at the inlet and outlet of the heating furnace are measured, the amount of heat necessary for heating the fluid, namely the heat load on the heating furnace, is calculated from the measured values, and when the heat load increases, the opening degree of a damper is increased beyond a predetermined level to feed air in an increased amount corresponding to the increasing heat load.

A still further object of the present invention is to provide a method and apparatus for controlling the amount of air for combustion in a natural draft type heating furnace, in which among the measured values such as draft pressure and damper opening degree, an abnormal value is checked and detected and when such abnormal value is detected, control, based on this measured abnormal value, is stopped to prevent erroneous control of the feed amount of air.

Other objects and features of the present invention will be apparent from the following description made with reference to the accompanying drawings.

DETAILED DESCRIPTION OF THE PREFERRED EMBODIMENTS

Figure 1:
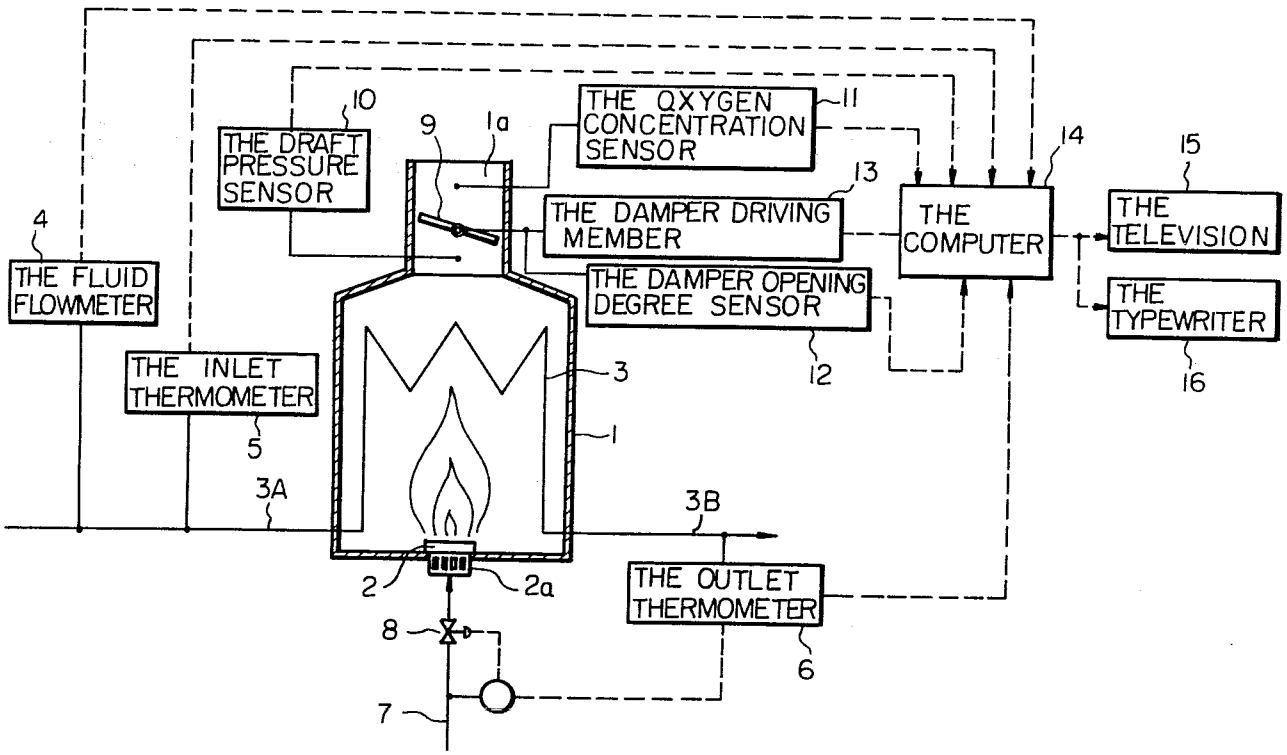
FIG. 1 is a diagram illustrating the outline of a natural draft type heating furnace provided with an apparatus for controlling the feed amount of air for combustion according to the present invention.
Figure 2A:
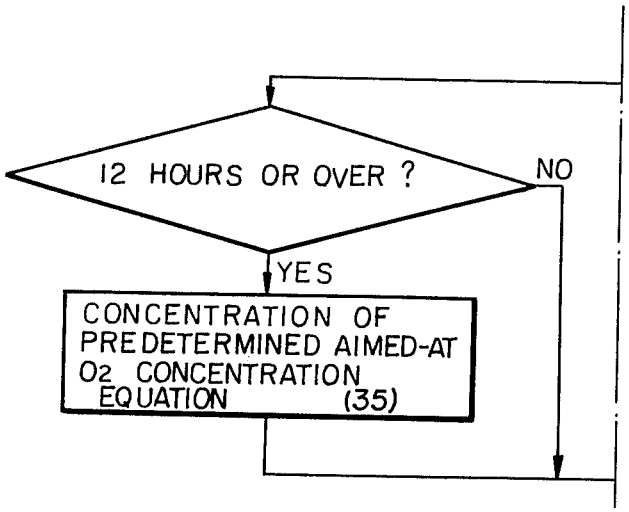
FIGS. 2(A), 2A(*a*), 2A(*b*), 2A(*c*), 2B, 2B(*a*), 2B(*b*), 2B(*c*) & 2C are flow charts illustrating the control program of an apparatus for controlling the feed amount of air for combustion according to the present invention.
Figure 2A:
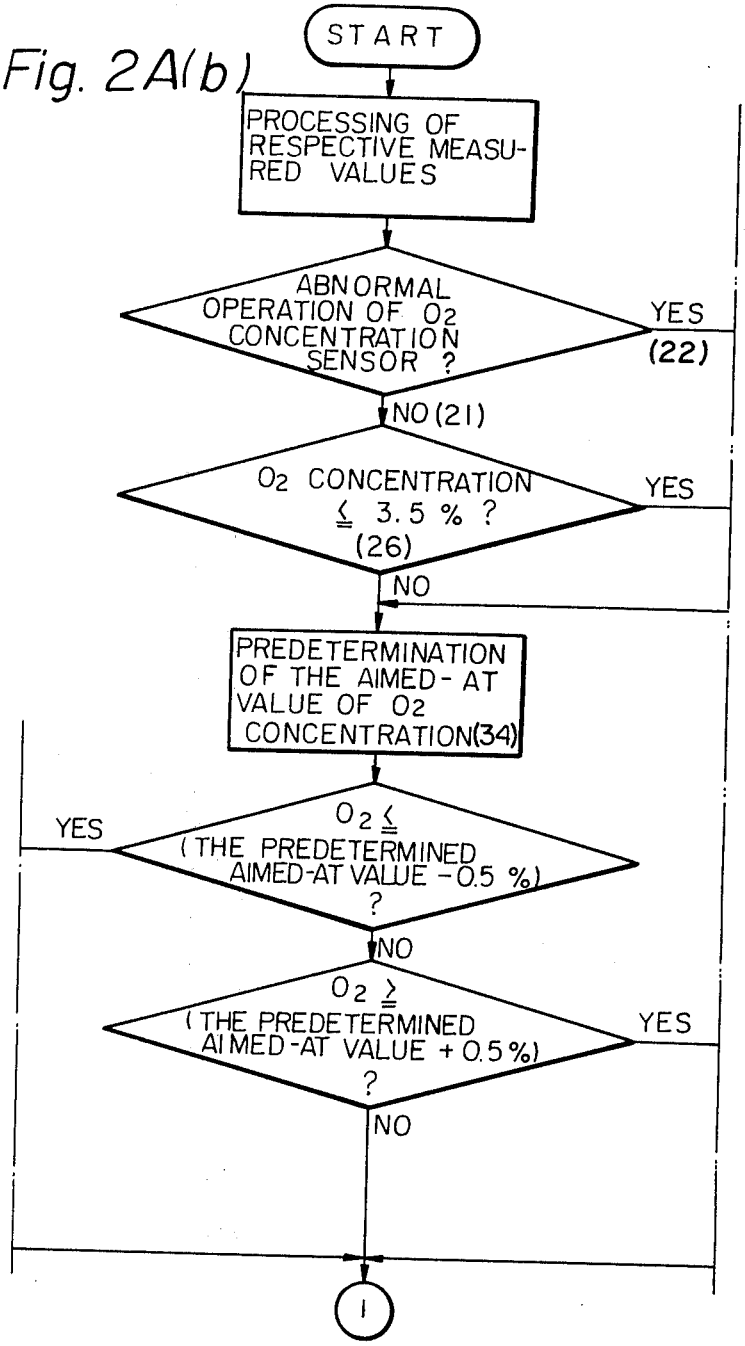
Figure 2A:
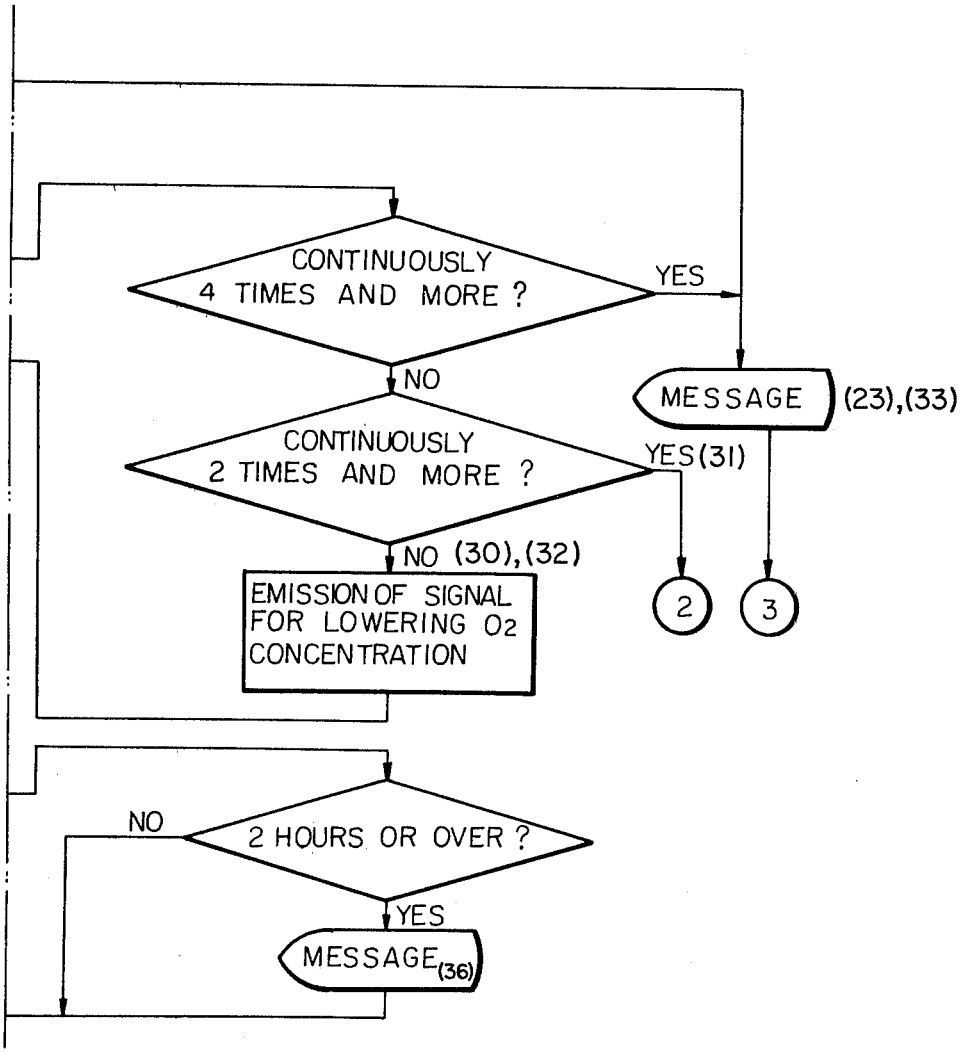
Figure 2B:
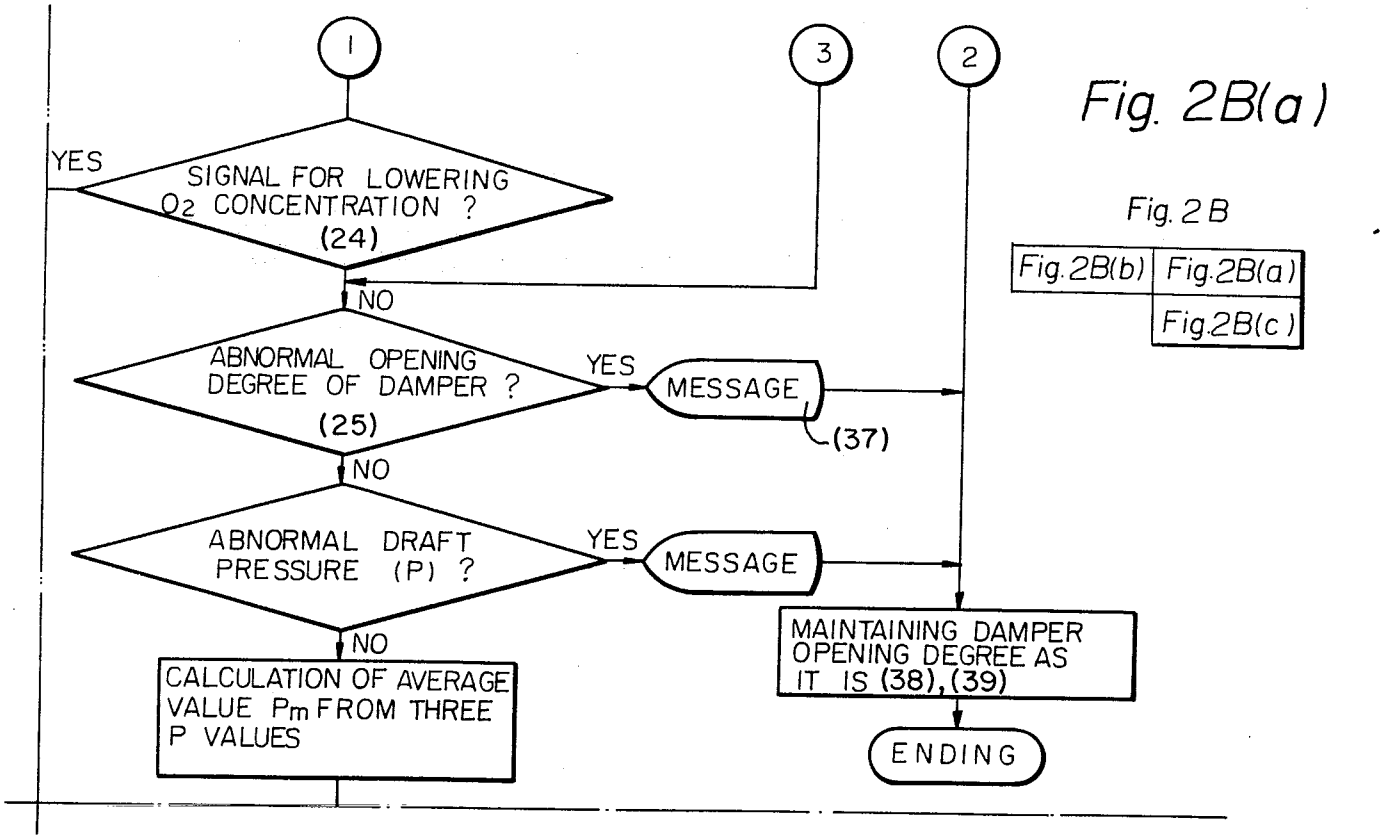
Figure 2B:
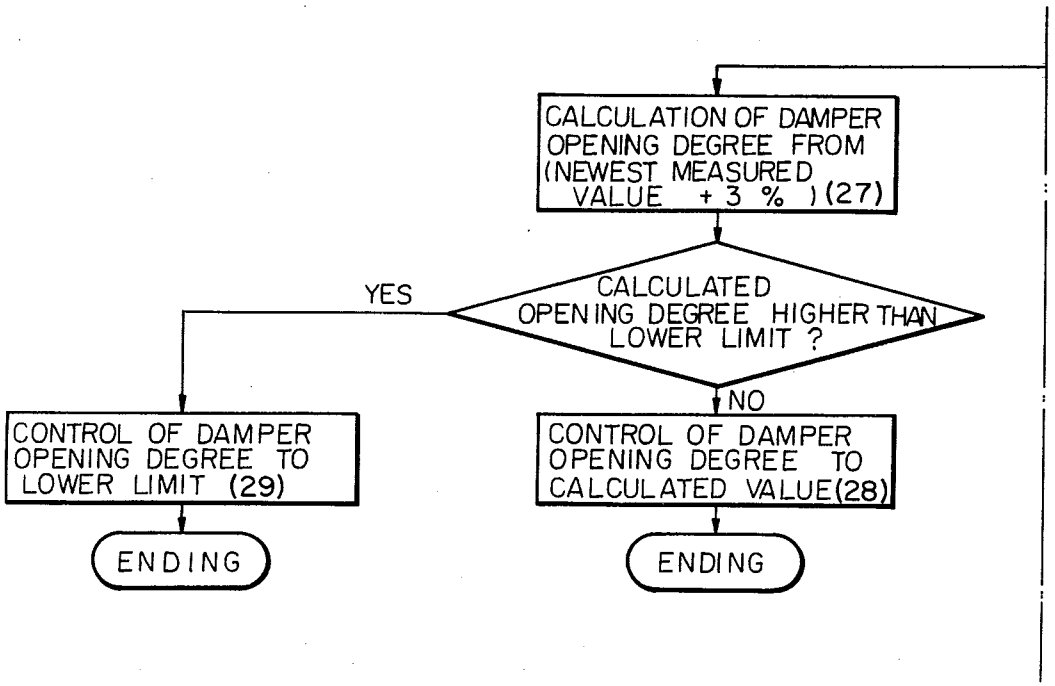
Figure 2B:
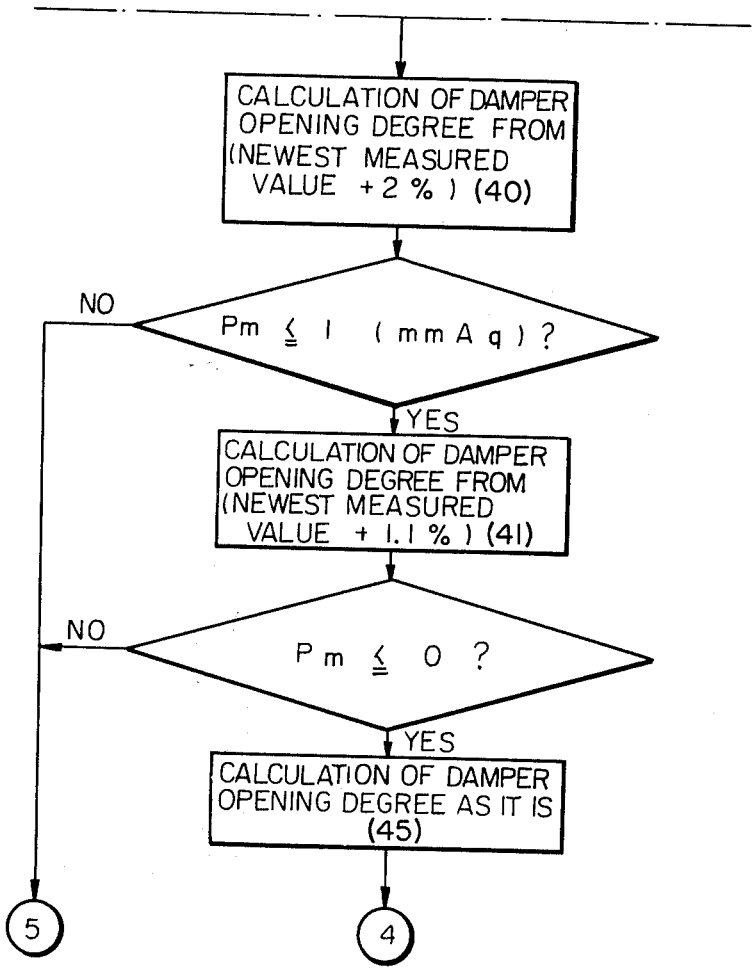
Figure 2C:
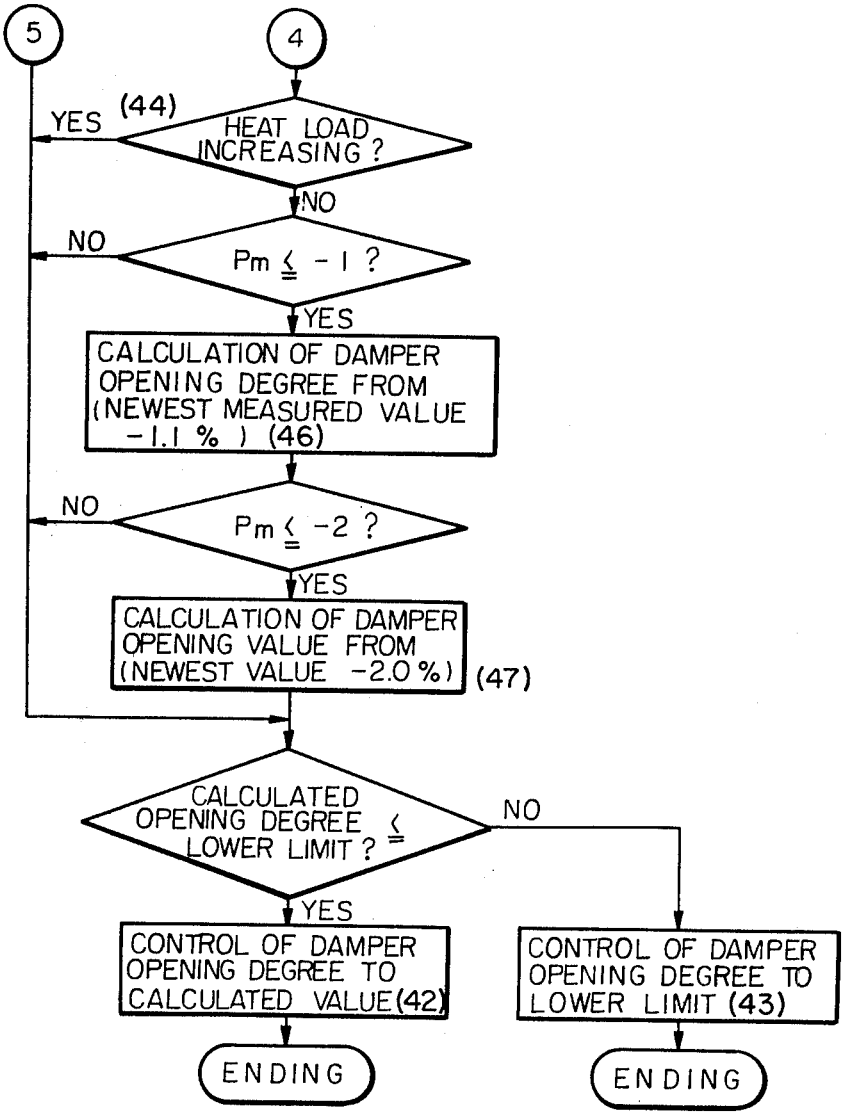

FIG. 1 illustrates an embodiment in which the control system of the present invention is applied to an apparatus for atmospheric pressure distillation of crude oils. Referring to FIG. 1, a burner 2 is attached to the central portion of the bottom wall of a natural draft type heating furnace 1 and a heat exchanger 3 is disposed in a space of the upper portion of the furnace 1. The heat exchanger 3 comprises flow pipes for a fluid to be heated supplied from a fluid source (not shown) via a supply pipe 3A, which pipes pierce through the side wall of the furnace body 1 and meander or run in the form of a coil in the interior of the furnace. The pipe walls of the heat exchanger 3 are heated by a combustion gas generated by combustion of fuel by the burner 2 and the heat exchange is effected between the fluid in the pipes of the heat exchanger 3 and this combustion gas. The fluid thus heated is delivered from the heat exchanger 3 to an apparatus, wherein the fluid may be utilized, via delivery pipe 3B. The burner 2 is provided with an opening for the intake of air for combustion and an air register 2*a* for adjusting the area of the air flow passage by manually turning the above intake opening. A fluid flow meter 4 and an inlet thermometer 5 are attached to the inlet portion of the heat exchanger 3, and an outlet thermometer 6 is attached to the outlet portion of the heat exchanger 3. In response to the temperature of the heated fluid measured by the outlet thermometer, the opening degree of a flow rate control valve 8 mounted on a fuel feed pipe 7 connected to the burner 2 and a fuel source (not shown) is automatically controlled so that the fuel is fed to the burner 2 in an amount corresponding to the quantity of heat required by the fluid to be heated. A damper 9 comprising a butterfly throttle valve is attached to a wall of an exhaust gas discharge duct 1*a* formed on the top portion of the heating furnace 1 to control the flow amount of the exhaust gas by increasing or decreasing the open area of the opening passage and thereby controlling the amount of air to be introduced into the heating furnace 1. In the exhaust gas discharge duct 1*a*, a draft pressure sensor 10 and an open oxygen concentration sensor 11 are arranged upstream and downstream of the damper 9, respectively. An opening degree sensor 12 for detecting the opening degree of the damper 9 and a damper driving member 13 for turning the damper 9 are connected to the damper 9.

Measurement signals from the flow meter 4 for the fluid to be heated, the thermometers 5 and 6, the draft pressure sensor 10 and the oxygen concentration sensor 11 are put at predetermined time intervals into a computer 14 acting as a device for controlling the opening degree of the damper 9 and a damper opening degree control signal calculated by the computer 14 according to the input signal is transmitted to the damper driving member 13 for actuating the driving member 13 to maintain an appropriate opening degree of the damper 9. When an abnormal value is detected among the foregoing measured values during the control, as will be described hereinafter, the computer 14 sends information of the abnormal value to a television 15 and a typewriter 16 to display and record the abnormal state.

The computer control program of the combustion control system having the above-mentioned structure will now be described by reference to FIG. 2.

Measurement signals from the respective sensors are put in the computer 14 at 3 minutes intervals. The newest measured values and the values of the two preceding measurements are set in one group at a data processing zone of the computer 14. Namely, when the newest measured values are received, data of the measured values obtained from the three most recent measurements are put in the computer in one group while the data of the measurement preceding the oldest measurement of these three recent measurements are cleared. In short, the moving average value system is adopted.

While the two measurements are conducted after the start of the operation, the opening degree of the damper is maintained at its original level and when the data of the third measurement are put in, the control is preformed according to the following program.

At first, it is checked whether or not the measured value of the oxygen concentration sensor 11 is checked to confirm whether same is abnormal or normal. If the opening degree of the damper 9 is kept high for a long period of time due to erroneous operation of the oxygen concentration sensor 11, the actual oxygen concentration in the heating furnace 1 is abnormally increased and the fuel is inevitably fed in a very excessive amount resulting in reduction of economical utilization of the fuel. Accordingly, the abnormal operation of the oxygen concentration sensor 11 is first checked.

When the newest measured value of the oxygen concentration in the exhaust gas (the weight ratio of the amount of oxygen to the amount of exhaust gas) is within a predetermined range (for example, 3 to 9%) or the difference between the newest measured value and the value obtained at the preceding measurement is within ±1%, it is judged that the measured value of the oxygen concentration is normal (21). If one of the above two requirements is not satisfied, it is judged that the operation of the oxygen concentration sensor 11 is abnormal (22).

When the operation of the oxygen concentration sensor 11 is judged as being normal, the measured value of the oxygen concentration in the exhaust gas is compared with the predetermined aimed-at oxygen concentration (a theoretical value of the oxygen concentration for maintaining an optimum combustion state in the draft furnace) as described hereinafter. When abnormal operation of the oxygen concentration sensor 11 is detected, the afore-mentioned comparison is not made but information as to the abnormal operation is sent to a monitor through the television 15 and typewriter 16 (this operation of sending information to the monitor through the television and typewriter will hereinafter be referred to merely as "transmittal of information") (23).

Next, the draft pressure sensor 10 and damper opening degree sensor 12 are checked to confirm whether same are acting normally (24, 25, respectively), and when confirmation is obtained, the opening degree of the damper is controlled according to the draft pressure.

After confirmation is obtained in the above-mentioned manner that the oxygen concentration sensor 11 is acting normally, the newest measured value of the oxygen concentration in the exhaust gas is checked to confirm whether or not is lower than 3.5% (higher than 3.0%) (26). If the oxygen concentration is lower than 3.5%, but higher 3.0% the oxygen concentration is still considered as being low, and therefore the opening degree of the damper is slightly increased. More specifically, an absolute opening degree of the damper is calculated by increasing the measured opening degree slightly, for example, by 3% based on the measured value (27) and if this calculated value is larger than the predetermined lower limit of the opening degree of the damper, the opening degree of the damper 9 is controlled to be adjusted to this calculated value (28). If the calculated value is smaller than the above-mentioned lower limit, the opening degree of the damper 9 is controlled to be adjusted to this lower limit (29). In short, a larger value between the calculated value and the lower limit is adopted. When the oxygen concentration in the exhaust gas is lower than the allowable lower limit, the amount of oxygen in the draft furnace is oridinarily insufficient and incomplete combustion or explosive combustion is readily caused as described hereinbefore. Accordingly, in such a case, the opening degree of the damper is slightly increased to increase the amount of oxygen fed into the furnace.

The above control will now be described in more detail. When the first measurement is carried out (30) at the start of the operation and oxygen concentration is detected as being too low (for example, lower than 3.5%), the opening degree of the damper 9 is increased (27) as described above. When the value obtained at the second measurement is still lower than the predetermined level, for example, 3.5%, the opening degree of the damper is maintained as it is (31). When the value obtained during the third measurement is still lower than the predetermined level, the opening degree of the damper is further increased by, for example, 3% (32). If the oxygen concentration is still lower than 3.5% even after the foregoing operation has been repeated 4 times, it is judged that the abnormal measured value of the oxygen concentration is due to an abnormal operation of the oxygen concentration sensor 11 and control based on the oxygen concentration is not performed, but rather this abnormal operation information is transmitted and the opening degree of the damper is controlled based on the draft pressure (33). By adoption of this control system, even if the oxygen concentration sensor 11 performs abnormally, it is possible to avoid occurrence of an undesirable phenomenon whereby the opening degree of the damper is kept high for a long time and economical utilization of the fuel is reduced.

Next, the quantity of heat necessary for heating the fluid to be heated, i.e., the heat load on the heating furnace, is calculated from the flow rate of the fluid and the difference of the temperatures of the fluid between the inlet and outlet of the heating furnace, and the aimed oxygen concentration is derived from a predetermined relation equation of the heat load and the oxygen concentration in the combustion gas and it is stored in a memory zone of the computer (34). This relation equation is formulated so that a relatively large predetermined aimed-at value of the oxygen concentration will be obtained.

When the state where the measured values of the oxygen concentration in the combustion gas are lower by at least 0.5% than the predetermined aimed-at oxygen concentration value, is continued for 12 hours or more, the above-mentioned predetermined aimed-at value is cleared and a new corrected aimed-at value is determined by subtracting a certain value from the preceding aimed-at value (for example, the constant of the predetermined aimed-at oxygen concentration equation is decreased by 0.2%) and is stored in the computer (35). In contrast, when measured values are higher by at least 0.5% than the predetermined aimed-at oxygen concentration, this state is transmitted to reduce the opening degree of the air register 2*a* of the burner 2 and decrease the feed amount of air (36).

Namely, when the measured values of the oxygen concentration are continuously lower than the predetermined aimed-at oxygen concentration value for a period longer than the predetermined period, it is judged that the predetermined aimed-at oxygen concentration value is too high and the predetermined aimed-at oxygen concentration value is automatically corrected to be reduced (the predetermined aimed-at oxygen concentration value is automatically corrected), and when the measured value is within an allowable range of thus thus corrected aimed-at oxygen concentration value (%), this corrected value is adopted as the new aimed-at oxygen concentration value. If necessary, such correction procedures are repeated for obtaining an appropriately aimed-at oxygen concentration value. When the measured values are continuously higher than this corrected aimed-at oxygen concentration value for a period longer than the predetermined period, information of this state is transmitted to control which decreases the feed amount of air and as a result, the oxygen concentration in the exhaust gas is included within an allowable range of the aimed-at oxygen concentration. Accordingly, the oxygen concentration in the exhaust gas can be maintained at a minimum level and economical utilization of the fuel is enhanced.

As will be apparent from the foregoing illustration, in the present invention, a temporary determined aimed-at oxygen concentration value, which is relatively large, is tentatively set, and by comparing actual measured values with this predetermined aimed-at value and making a correction on this temporary predetermined aimed-at value, a more accurate aimed value is obtained. Such procedures are adopted in the present invention for preventing occurrence of an accident of the heating furnace owing to a low oxygen concentration.

Next, the abnormal operation of the damper opening degree sensor 12 is detected, Namely, when it is found that the opening degree of the damper 9 is lower than the lower limit, for example, 60% or the difference of the newest measured value from the preceding measured value is outside the range of ±5%, it is judged that the operation of the damper opening degree sensor 12 is abnormal, and information of this abnormal state is transmitted (37) while stopping control of the opening degree of the damper by the draft pressure and keeping the present opening degree of the damper as it is (38).

Subsequently, it is checked whether or not the operation of the draft pressure sensor is checked to determine whether same is normal or not. When the measured value is outside the range of 4~3 mmAq or the difference between the newest measurement value and the value obtained at the preceding measurement is over ±2 mmAq, the opening degree of the damper is kept as it is, as described above (39).

If an abnormal state is detected with respect to any of the above-mentioned check items, the abnormal part is immediately inspected and the normal state is restored by manual control.

When both the damper opening degree and draft pressure are determined as being normal, or when the abnormal measured value of the oxygen concentration in the combustion gas is due to the abnormal operation of the oxygen concentration sensor 11, the opening degree of the damper 9 is controlled based on the draft pressure, which is the main control for the opening degree of the damper.

At first, an average value Pm of the draft pressure is calculated from the newest measured value and two preceding measured values of the draft pressure and the opening degree of the damper is calculated by the computer on the condition that in case of $Pm > 1.0$ mmAq (the unit is omitted hereinafter), the damper 9 is opened by 2.0% (40) and in case of $0 < Pm \leqq 1.0$ the damper is opened by 1.1% (41). When the calculated opening degree value is higher than the lower limit of the opening degree, the opening degree is controlled to be adjusted to the calculated value (42) and when the calculated value is lower than the lower limit, the opening degree is controlled to be adjusted to the lower limit (43).

In case of $Pm \leqq 0.0$, same is checked based on the flow rate of the fluid to be heated and the difference of the inlet and outlet temperatures as to whether or not the heat load on the draft furnace is increasing (the inlet temperature of the fluid is lowered or the flow rate of the fluid is increased). If it is found that the heat load on the draft furnace is increasing (44), the opening degree is controlled to be adjusted to the actual opening degree when the actual opening degree is higher than the lower limit of the opening degree, or the opening degree of the damper is controlled to be adjusted to the lower limit when the actual opening degree is lower than the lower limit.

Namely, while the heat load is increasing, the feed amount of air is also increasing and therefore, even in case of $Pm \leqq 0.0$, the damper is not closed, in spite of the draft pressure state.

In the case where the heat load is not increasing, the opening degree of the damper is kept as it is in case of $-1 < Pm \leqq 0.0$ (45) or the opening degree of the damper is calculated so that the damper is closed by 1.1% in case of $-2 < Pm \leqq -1$ (46) or by 2.0% in case of $Pm < -2$ (47). If the calculated value of the opening of the damper is higher than the lower limit of the opening degree of the damper, the opening degree is controlled to be adjusted to the calculated value and when the calculated value is lower than the lower limit, the opening degree is controlled to be adjusted to the lower limit.

As will be apparent from the foregoing illustration, according to the basic control of the present invention, the damper is closed or opened according to an increase or decrease of the draft pressure to control the amount of air fed into the furnace at an appropriate level.

When the apparatus of the present invention is applied to the control furnace of a heating furnace of the system for atmospheric pressure distillation of crude oils, if the predetermined value of the draft pressure is set at 0 to −2 mmAq, the moving average value of the measured values of the draft pressure is −1.12 mmAq. On the other hand, when the control predetermined aimed-at value of the draft pressure is similarly set at 0 to −2 mmAq in the conventional manual system of controlling the opening degree of the damper, the moving average value of the measured values is −1.76 mmAq. Thus, it is confirmed that according to the present invention, a negative pressure much closer to the positive pressure is obtained.

When the predetermined aimed-at value of the draft pressure is set at 0 to −1 mmAq, a moving average value of the measured value of the draft pressure is −0.61 mmAq and becomes more closer to the positive pressure value but also in this case, positive pressure values are hardly obtained.

Figure 3:
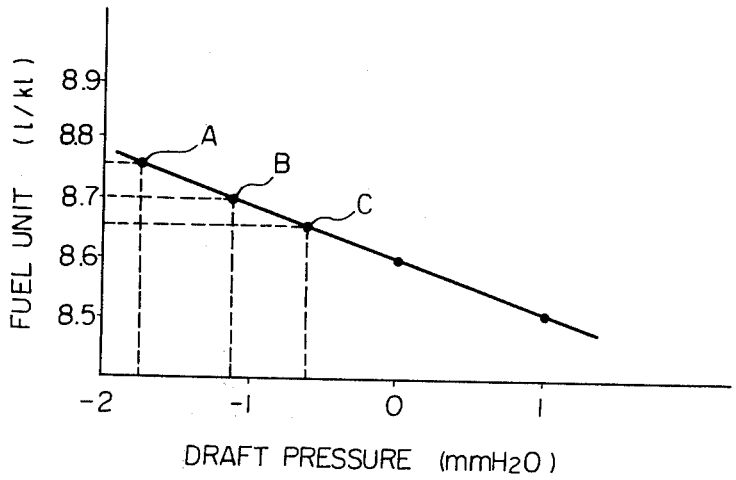
FIG. 3 is a graph illustrating the relation between the draft pressure and the fuel unit, which compares the control system of the present invention with the conventional manual control system with respect to economical utilization of the fuel in controlling the feed amount of air for combustion in a natural draft type heating furnace.

When such value of the draft pressure is converted into the fuel unit (1/Kl) of the fuel the amount (1) of the fuel necessary for heating 1 Kl of a fluid to a predetermined temperature indicating the economical utilization of the fuel, if the working ratio of the draft furnace is 90%, as shown in FIG. 3, the fuel unit is 8.70 1/Kl when the average value of the measured values is −1.12 mmAq (the predetermined value of the draft pressure is 0 to −2 mmAq) (see point B in FIG. 3). When the average value of the measured values is −0.61 mmAq (the predetermined value of the draft pressure is 0 to −1 mmAq), the fuel unit is 8.65 1/Kl (see point C in FIG. 3). On the other hand, in the case of the manual control system, when the average value is −1.76 mmAq (the predetermined aimed at control value of the draft pressure is 0 to −2 mmAq), the fuel unit is 8.75 1/Kl. Accordingly, the above two fuel units obtained according to the present invention are reduced by 0.6% and 1.1%, respectively, as compared with the fuel unit attainable according to the conventional manual control system. Namely, fuel consumption can be accordingly reduced and this economical advantage is especially conspicuous in the case of a heating furnace of this type which is operated continuously for a very long time.

As will be apparent from the foregoing illustration, according to the new method and apparatus of the present invention for controlling the feed amount of air in a natural draft type heating furnace, since the main control of the feed amount of air is performed by controlling the opening degree of the damper based on a moving average value of the newest measured value and several preceding measured values, the control operation is hardly influenced by temporary increase of the draft pressure, and therefore, a stable combustion state can be maintained and economical utilization of the fuel can be enhanced. Further, when the oxygen concentration in the exhaust gas is lower than the predetermined level and the amount of oxygen in the furnace is relatively insufficient, the damper is opened irrespective of the draft pressure, and therefore, incomplete combustion or explosive combustion can be effectively prevented. Further, since the control of the opening degree of the damper by the draft pressure is stopped when both the draft pressure and opening degree values are abnormal, erroneous control based on abnormal measured values can be prevented.

Still further, when there is adopted a structure in which the damper is not closed even if the draft pressure is lowered while the heat load is increasing, increase of the required air amount with increase of the heat load can be appropriately accomplished and shortage of oxygen in the heating furnace can be effectively prevented.

While the invention has been shown and described with reference to preferred embodiments thereof, it will be obvious to those skilled in the art that various changes and modifications may be made therein without departing from the scope of the invention as defined by the following claims.

What is claimed is:

1. A natural draft type heating furnace comprising a furnace body having an air intake opening and an exhaust gas discharge opening, through which air is naturally drafted, a burner mounted in the furnace body to ignite and burn a fuel, a heat exchanger disposed in a space of the furnace body downstream of said burner and arranged so that a fluid to be heated is heated by heat exchange with a combustion gas formed by combustion of the fuel by said burner while the fluid travels in the interior of the heat exchanger from an inlet thereof to an outlet thereof, a damper mounted on the exhaust gas discharge opening of the furnace body to open or close the passage area, damper driving means connected to said damper to open or close said damper, a pressure sensor for detecting the pressure in the furnace, an oxygen concentration sensor for detecting the oxygen concentration in the combustion gas in the furnace and a damper opening degree control system including first damper opening degree control means for controlling the damper driving means based on a moving average value of measured values of the pressure in the furnace obtained by conducting measurement of a predetermined number of times at predetermined time intervals, second damper opening degree control means for controlling the damper driving means to maintain the damper opening degree as it is when the measured value of the pressure in the furnace is an abnormal value and third damper opening degree control means for controlling the damper driving means to open said damper irrespective of the first damper opening degree control means when the measured value of the oxygen concentration in the combustion gas is lower than a predetermined lower limit.

2. A heating furnace as set forth in claim 1, wherein said burner includes an air register mounted on the air intake opening of the furnace body.

3. A heating furnace as set forth in claim 1, wherein said burner includes means for controlling the feed amount of the fuel.

4. A heating furnace as set forth in claim 3, wherein said means for controlling the feed amount of the fuel controls same according to the temperature of the fluid at the outlet of the heat exchanger.

5. A heating furnace as set forth in claim 1, wherein said damper is a butterfly throttle valve.

6. A heating furnace as set forth in claim 1, wherein said pressure sensor is disposed to detect the pressure in the furnace downstream of the damper located on the exhaust gas discharge opening of the furnace body.

7. A heating furnace as set forth in claim 1, wherein the first damper opening degree control means of the damper opening control system controls the damper driving means based on a moving average value of the newest measured value and two preceding measured values of the pressure in the furnace.

8. A heating furnace as set forth in claim 1, wherein the second damper opening degree control means of the damper opening control system is arranged so that same performs the control operation when the difference of the newest measured value of the pressure in the furnace from either of the two preceding measured values of the pressure in the furnace deviates from an allowable range.

9. A natural draft-type heating furnace comprising a furnace body having an air intake opening and an exhaust gas discharge opening, through which air is naturally drafted, a burner mounted in the furnace body to ignite and burn a fuel, a heat exchanger disposed in a space of the furnace body above said burner and arranged so that a fluid to be heated is heated by heat exchange with a combustion gas formed by combustion of the fuel by said burner while the fluid travels in the interior of the heat exchanger from an inlet thereof to an outlet thereof, a damper mounted on the exhaust gas discharge opening of the furnace body to open or close the passage area, damper driving means connected to said damper to open or close said damper, a pressure sensor for detecting the pressure in the furnace, an oxygen concentration sensor for detecting the oxygen concentration in the combustion gas in the furnace, heat load detecting means for detecting the quantity heat load necessary for heating the fluid to a predetermined level and a damper opening degree control system including first damper opening degree control means for controlling the damper driving means based on a moving average value of measured values of the pressure in the furnace obtained by conducting the measurement of a predetermined number of times at predetermined time intervals, second damper opening control means for controlling the damper driving means to maintain the damper opening degree as it is when the measured value of the pressure in the furnace is an abnormal value, third damper opening control means to open said damper irrespective of the first damper opening degree control means when the measured value of the oxygen concentration in the combustion gas is lower than a predetermined lower limit and fourth damper opening control means for controlling the damper driving means based on the quantity of heat load necessary for heating the fluid, detected by the heat load detecting means.

10. A heating furnace as set forth in claim 9 wherein said heat load detecting means is means for detecting said heat load based on the flow rate of the fluid to be heated and the temperature of the fluid at the inlet and outlet of the heat exchanger.

11. In a natural draft-type heating furnace comprising a heat exchanger through which a fluid to be heated flows, a heating burner and a damper mounted on a combustion gas discharge opening, wherein air is naturally drafted through the interior of the furnace and the feed amount of air for combustion is controlled by controlling the opening degree of said damper, a method of controlling the feed amount of air for combustion comprises a first step of detecting the pressure in the furnace at predetermined time intervals and controlling the damper opening degree based on a moving average value of measured values of the pressure in the furnace obtained by conducting the measurement a plurality of times, a second step of stopping the control of the first step when the measured value of the pressure in the furnace at the first step is an abnormal value and controlling the damper to maintain the damper opening degree as it is, and a third step of detecting the oxygen concentration in the combustion gas in the furnace and stopping function of said first step as well as opening said damper to attain a predetermined opening degree in the damper when the oxygen concentration in the combustion gas is lower than a predetermined lower limit.

12. A method for controlling the feed amount of air for combustion according to claim 11, wherein at said first step, the damper opening degree is controlled based on a moving average value of the newest measured value and two preceding measured values of the pressure in the furnace.

13. In a natural draft type heating furnace comprising a heat exchanger through which a fluid to be heated flows, a heating burner and a damper mounted on a combustion gas discharge opening, wherein air is naturally drafted through the interior of the furnace and the feed amount of air for combustion is controlled by controlling the opening degree of said damper, a method of controlling the feed amount of air for combustion comprises a first step of detecting the pressure in the furnace at predetermined time intervals and controlling the damper opening degree based on a moving average value of measured values of the pressure in the furnace obtained by conducting the measurement a plurality of times a second step of stopping the control of a first step when the measured value of the pressure in the furnace at the first step is an abnormal value and controlling the damper to maintain the damper opening degree as it is, third step of detecting the oxygen concentration in the combustion gas in the furnace and stopping function of said first step as well as opening said damper to attain a predetermined opening degree in the damper when the oxygen concentration in the combustion gas in lower than a predetermined lower limit and a fourth step of detecting heat load necessary for heating the fluid by measuring the flow rate of the fluid to be heated and the temperatures of the fluid at the inlet and outlet of said heat exchanger and controlling said damper not to close when the increasing heat load is detected.

14. In a natural draft type heating furnace comprising a heat exchanger through which a fluid to be heated flows, a heating burner and a damper mounted on a combustion gas discharge opening, wherein air is naturally drafted through the interior of the furnace and the feed amount of air for combustion is controlled by controlling the opening degree of said damper, a method of controlling the feed amount of air for combustion comprises a first step of detecting the pressure in the furnace at predetermined time intervals and controlling the damper opening degree based on a moving average value of measured values of the pressure in the furnace obtained by conducting the measurement a plurality of times a second step of stopping the control of a first step when the measured value of the pressure in the furnace at the first step is an abnormal value and controlling the damper to maintain the damper opening degree as it is, third step of detecting the oxygen concentration in the combustion gas in the furnace and stopping function of said first step as well as opening said damper to attain a predetermined opening degree in the damper when the oxygen concentration in the combustion gas in lower than a predetermined lower limit, a fourth step of detecting the heat load necessary for heating the fluid by measuring the flow rate of the fluid to be heated and the temperatures of the fluid at the inlet and outlet of said heat exchanger and controlling said damper not to close when the increasing heat load is detected and a fifth step of determining an optimum aimed-at value of the oxygen concentration based on the value of the oxygen concentration in the combustion gas detected at said third step and the necessary heat load detected at said fourth step and controlling the opening degree of an air-introducing inlet of said burner so that the actual oxygen concentration in the combustion gas is brought close to said aimed-at value of the oxygen concentration.

15. A method for controlling the feed amount of oxygen for combustion according to claim 14 wherein at the fifth step, the detected value of the oxygen concentration is compared with a theoretically determined aimed-at value of the oxygen concentration, when the state where the detected value of the oxygen concentration is lower than the theoretically predetermined aimed-at value of the oxygen concentration and the difference between said two values is larger than a predetermined limit is continued for a period longer than a predetermined period, the preceding predetermined aimed at value of the oxygen concentration is cleared and then a new optimum aimed-at value of the oxygen concentration is determined by subtracting a certain value from the preceding predetermined aimed-at value of the oxygen concentration, and when the state where the detected value of the oxygen concentration is higher than the preceding predetermined aimed-at value of the oxygen concentration and the difference between said two values is larger than a predetermined limit is continued for a period longer than a predetermined period, said burner is controlled so that the opening degree of the air-intake opening intake thereof is increased.

* * * * *